US005775209A

United States Patent [19]

Tiemann

[11] Patent Number: 5,775,209

[45] Date of Patent: Jul. 7, 1998

[54] MULTI-LAYER BAKING AND COOLING RACK

[75] Inventor: Frank Tiemann, Braham, Minn.

[73] Assignee: T&L Nifty Products Co. Inc., Braham, Minn.

[21] Appl. No.: 831,763

[22] Filed: Apr. 1, 1997

[51] Int. Cl.[6] ..... A47J 27/00; A47J 37/00

[52] U.S. Cl. ..... 99/426; 99/449; 99/450; 211/181.1; 211/195; 220/485; 220/491

[58] Field of Search ..... 99/345–347, 339, 99/340, 426, 427, 449, 450; 126/9 R, 25 R, 25 A, 369; 211/181.1, 195, 46, 162; 220/485, 491, 486, 494; 206/423, 427, 512; D7/404; D6/566

[56] References Cited

U.S. PATENT DOCUMENTS

| | | | |
|---|---|---|---|
| D. 321,804 | 11/1991 | Wolff et al. | D7/404 |
| D. 368,186 | 3/1996 | Tiemann | D6/566 X |
| D. 369,933 | 5/1996 | Tiemann | D6/566 |
| 4,171,151 | 10/1979 | Luck | 312/236 |
| 4,191,160 | 3/1980 | Elliott | 126/9 R |
| 4,458,585 | 7/1984 | Erbach | 99/448 X |
| 4,481,874 | 11/1984 | Greck | 211/181.1 |
| 4,633,773 | 1/1987 | Jay | 99/426 |
| 5,103,799 | 4/1992 | Atanasio | 126/9 R |
| 5,421,246 | 6/1995 | Tippmann et al. | 99/426 |
| 5,558,237 | 9/1996 | Anconal | 99/426 |
| 5,560,286 | 10/1996 | Fabrikant et al. | 99/426 |
| 5,638,742 | 6/1997 | Kassaseya | 99/449 X |

*Primary Examiner*—Timothy F. Simone
*Attorney, Agent, or Firm*—James R. Cwayna

[57] ABSTRACT

A multi-layer or multi-shelf baking and cooling rack which provides a plurality of layer surfaces which will fit into an oven of a stove for receiving articles to be baked thereon. Its lower layer will rest upon the lowest positioned oven shelf and provide three layers in spaced vertical relation thereabove with the normal second shelf of the oven being positionable upon the upper oven rack supports to provide four baking levels. The unit is removable from the oven for cooling of the baked products. The unit consists of a lower rack having a forward and rearward leg rotatable thereon into vertical positions. The rearward leg is provided with a pair of spaced shelf elements rotatably attached thereto with the frontmost ends of such shelf elements provided with hook elements to engage with the forward leg of the lower rack when the same is shifted to its vertical position. The rotatable connections allow for complete collapsing of the unit for storage purposes.

5 Claims, 3 Drawing Sheets

MULTI-LAYER BAKING AND COOLING RACK

RELATED APPLICATIONS

There are no applications currently on file in the United States Patent Office by Applicant or, to the best of his knowledge, by others, which relate to the subject matter disclosed herein.

FEDERAL SPONSORSHIP

This invention has not been made under any Federally sponsored research and development arrangement nor under any other research and development agreement.

FIELD OF THE INVENTION

This invention relates generally to multi-layer racks insertable and removable from an oven for baking and subsequent cooling of baked products and more specifically to such a rack which includes a lower shelf having a rear and forward leg, both of which are rotatably connected thereto to permit shifting thereof into vertical relation with respect to the lower shelf with the rear leg having at least a pair of spaced shelf members rotatably attached thereto permitting shifting of the same to be parallel to the lower shelf with each of such shelves having hook elements at the forward end thereof to lock about the forward leg when the same is shifted to a vertical position to thus provide a generally rectangular shape to the formed unit. The rotatable connections between all portions of the unit allow for collapsing of the unit for storage purposes.

SUMMARY OF THE INVENTION

A multi-layer unit which is insertable and removable from an oven for baking and subsequent cooling of baked products. The unit will, in a preferred form, provide three shelves including a lower, middle and upper shelf The lower shelf is provided with both a rotatably mounted forward and rear leg. The middle and upper shelves are rotatably connected to the rear leg and are provided with hooks on the forwardmost ends thereof. When the forward leg of the lower shelf is shifted to a vertical position, these hooks will engage the same to secure the unit into a rectangular configuration and provide a plurality of spaced shelves which is placeable into an oven, normally resting on the lower oven shelf, and providing two additional shelves thereabove to increase the useable oven space. The unit is removable from the oven without disassembly for cooling purposes.

BACKGROUND AND OBJECTS OF THE INVENTION

A baking oven of a stove will normally only provide two shelves which does not effectively utilize the baking capacity of an oven. It is certainly conceivable that additional shelves could be purchased but in continuous cooking of batches of a product it is necessary to remove the baked product from the oven and accommodate cooling thereof Applicant provides a collapsible, multi-layer unit which will effectively increase the cooking capacity of an oven and which is removable from the oven for cooling of the baked product. With applicant's unit, the unit is positioned on a provided oven shelf which is placed at its lowermost supported position and rests thereon to provide a plurality of shelves. The second, normally provided oven shelf, is then positionable onto the uppermost rack supports of the oven to provide a minimum of at least four shelf areas.

To obtain this configuration and improved oven space usage. Applicant provides a collapsible unit which basically consists of three or more shelves, including at least a lower, middle and upper shelf and a forward and rear leg which are rotatably mounted to the lower shelf with the middle and upper shelves being rotatably mounted to one of the rear or forward rotatable, shiftable legs. When these legs are brought into a vertical or normal position with respect to the lower shelf, the other shelves are shifted to a position parallel to the lower shelf and hooks on such shelves engage the other leg to thus hold the unit in a stable, rectangular position.

Rotation of all elements of the unit allow total collapse of the same for storage and either forming or collapse of the unit does not require any element or part removal which could result in loss of the same.

It is therefore an object of the invention to provide a multi-layer shelf unit for improved utilization of oven space.

It is a further object of the applicant's invention to provide a multi-layer baking or cooling rack which is substantially collapsible for storage and which includes a plurality of rotatably connected elements for shifting the same into a substantially rectangular, three dimensional unit which provides a plurality of spaced article supporting racks.

It is still a further object of the applicant's invention to provide a baking and cooling rack insertable into an oven of a stove for baking of articles and which is removable therefrom without disassembly for cooling of the baked articles.

These and other objects and advantages of the applicant's invention will more fully appear from a consideration of the accompanying disclosure and drawings

DESCRIPTION OF A PREFERRED FORM OF THE INVENTION

Figure 1:
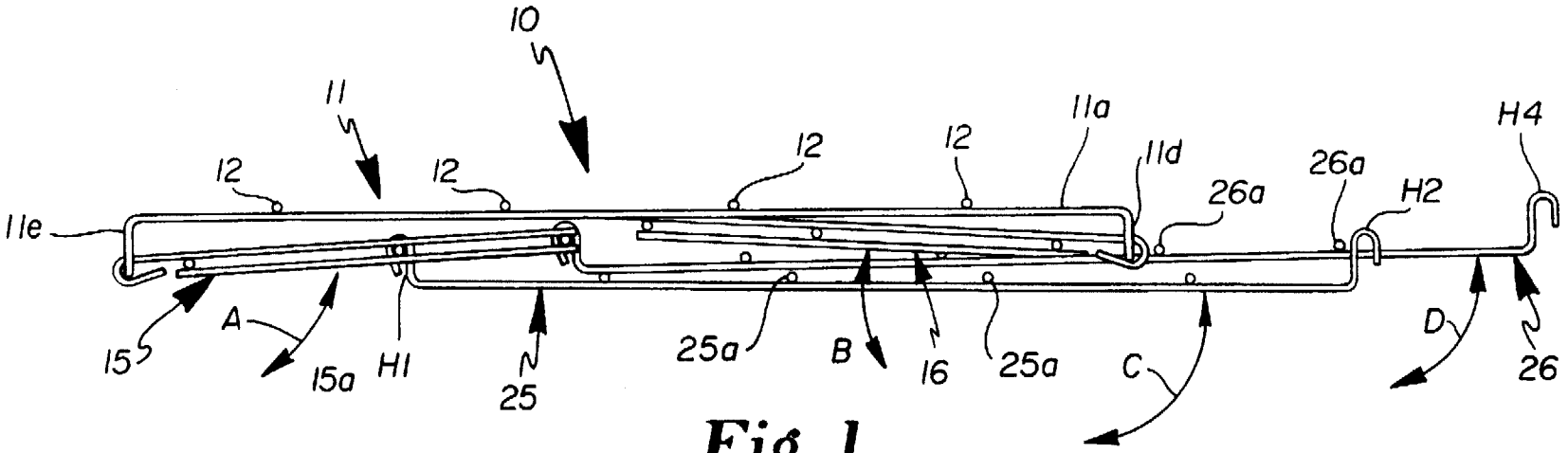
FIG. 1 is a side elevation illustration the baking and cooking rack embodying the concepts of the Applicant's invention in its collapsed condition and illustrating, through arrows, the unfolding to its use shape.
Figure 4:
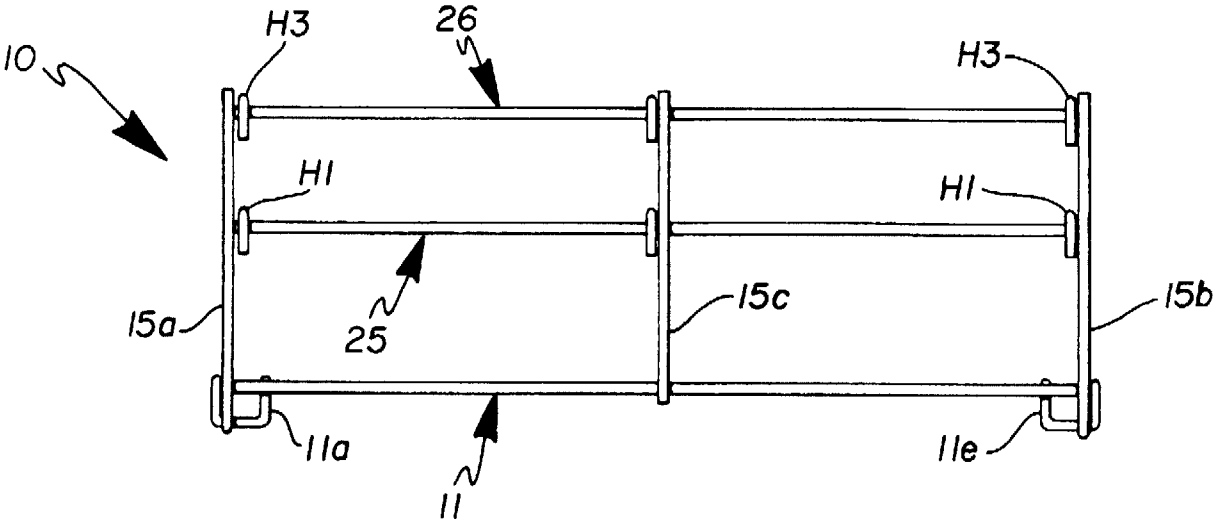
Figure 2:
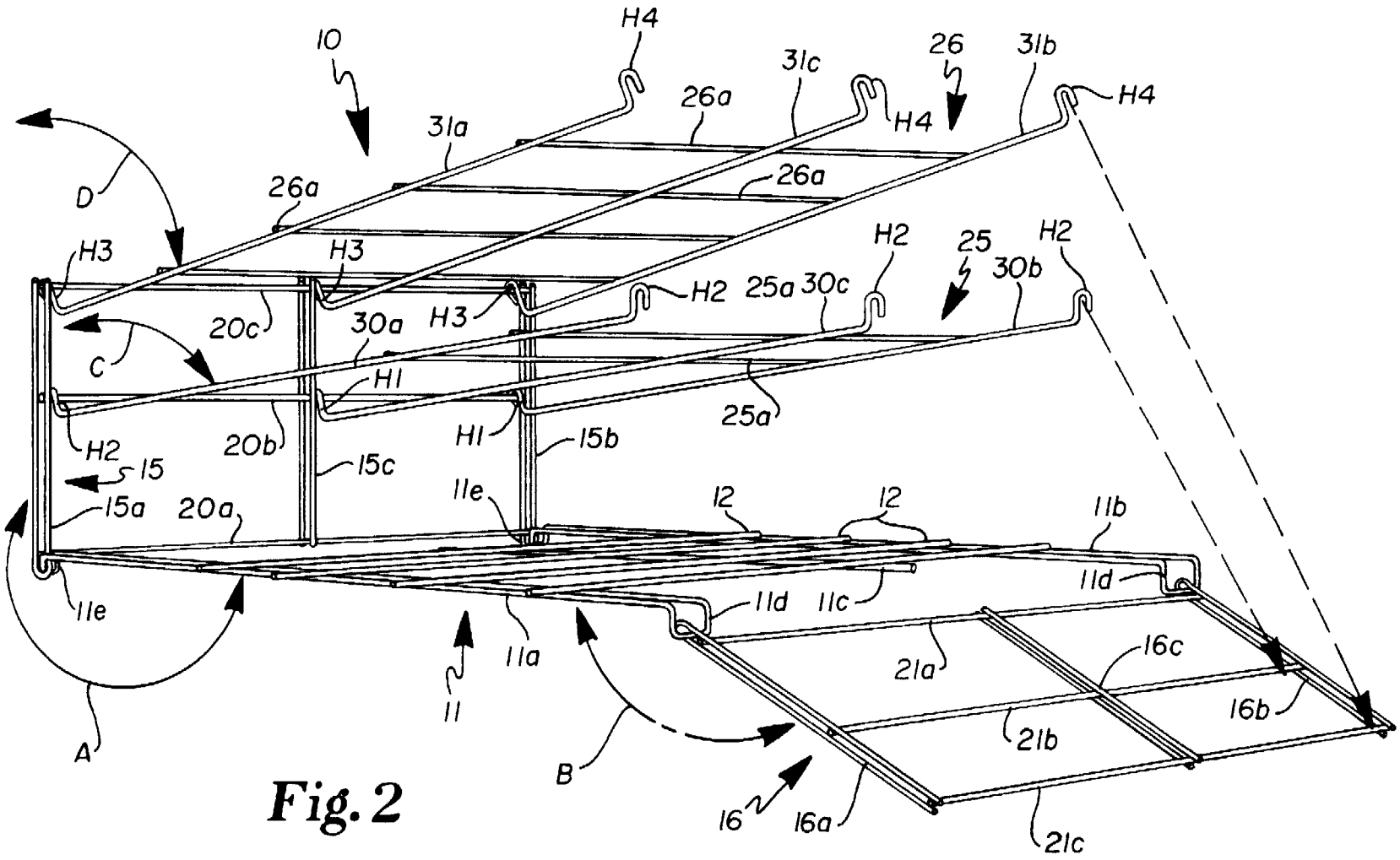
FIG. 2 is a perspective view of the rack as the elements thereof are swung into their operative positions as illustrated by corresponding arrows.
Figure 3:
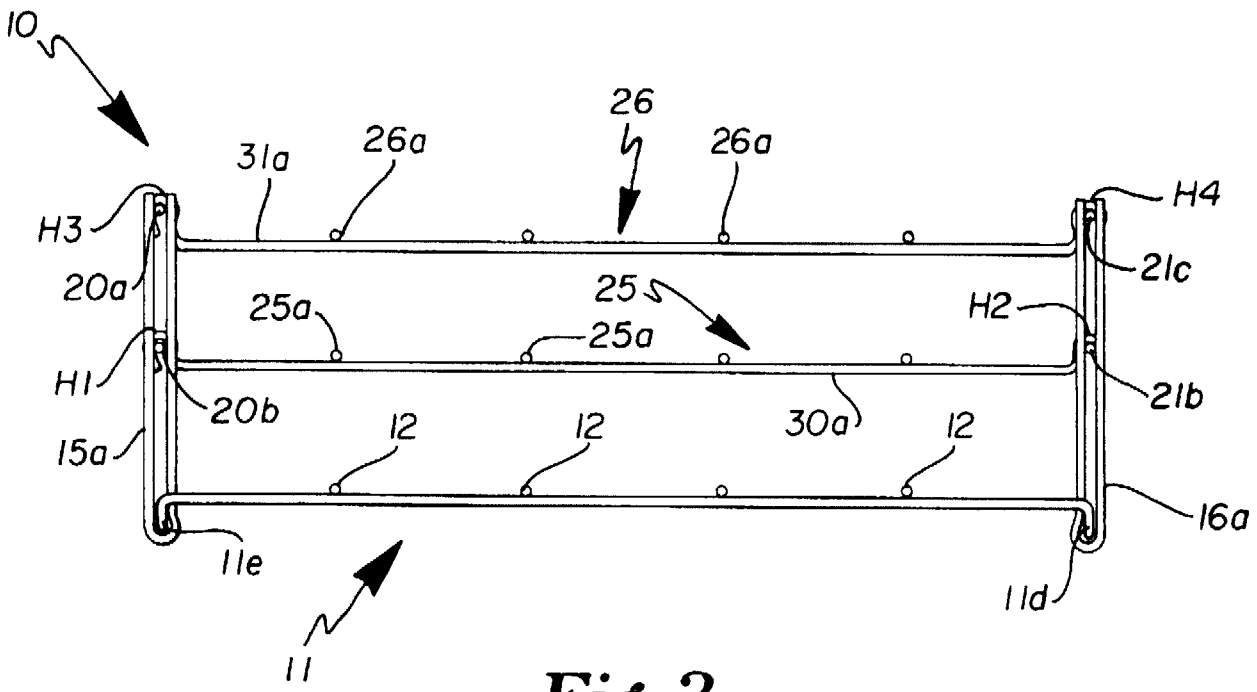
FIG. 3 is an elevation taken from one side thereof, the opposite side being a mirror image thereof; and, FIG. 4 is a front elevation thereof, the rear being a mirror image thereof.

In accordance with the accompanying drawings, applicant's multi-layer baking and cooking rack is generally designated 10 and is illustrated in collapsed, storage position in FIG. 1, transition or unfolding position in FIG. 2 with one side and a front view illustrated in FIGS. 3 and 4. The opposite side of the rack 10 is a mirror image of the side illustrated and similarly, the back of the rack is a mirror image of the front. FIG. 2 particularly illustrates an unfolding sequence as will be discussed hereinafter.

The rack 10 includes a lower shelf member 11 of a predetermined width and length, a pair of legs 15, 16 and a pair of support shelves 25, 26 both of which are of the same size and correspond with the chosen dimensions of the lower shelf 11 such that upon unfolding and arranging for support of articles to be baked and cooled, in combination with the legs 15, 16, a rectangular configuration is provided having a height as determined by the length of legs 15, 16.

Lower shelf member 11 includes a pair of double side supports 11*a*, 11*b* and a single mid-support 11*c*, all of which are oriented in a first direction and all of which are parallel to one another. As illustrated, the ends of such double side supports, as at 11*d*, 11*e* are bent or formed at right angles to the remainder of the shelf 11 to provide hook and rotatable capturing areas for legs, 15, 16. A plurality of spaced cross members, all designated 12, are positioned to extend entirely between the side supports 11*a*, 11*b* and over mid-support 11*c* and are arranged normal thereto and are secured thereto by welding or the like. The number of cross members 12 may vary dependent upon desired unit size but it can be seen that an open grid is provided for both heat passing during baking and heat release for cooling.

Each of the legs 15, 16 include double end sections 15*a*, 15*b*, 16*a*, 16*b* as well as double mid-supports 15*c*, 16*c*. As illustrated, the double construction for the side supports 11*a*, 11*b* of lower shelf 11 and corresponding double end sections 15*a*, 15*b*, 16*a*, 16*b* provides for rotatable connection therebetween which will allow the legs 15, 16 to be shifted from a first collapsed position wherein they are closely positioned next to lower shelf 11 as shown in FIG. 1 to the position illustrated in FIGS. 2, 3 and 4. Arrow A, of both Figures, illustrates the rotation of leg 15 from its position adjacent lower shelf 11 to a position where it is generally normal to lower shelf 11. Arrow B, of both Figures, illustrates the rotation of leg 16 from a position adjacent lower shelf member 11 to a position where it is generally normal to shelf 11.

Each of the legs 15, 16 include spaced cross members 20*a*, 20*b*, 20*c* and 21*a*, 21*b*, 21*c* for lateral support and middle 25 and top 26 shelf mounting.

In the form shown, three such cross members 20*a*, 20*b*, 20*c* and 21*a*, 21*b*, 21*c* are provided and, similarly, Applicant has chosen to illustrate a unit 10 having a lower 11, middle 23 and top 26 shelf, but it should be obvious that the number of shelves could be increased or decreased, using Applicant's basic concept.

As illustrated, the middle 25 and top 26 shelves each include sides 30*a*, 31*a*, 30*b*, 31*b* and middle 30*c*, 31*c* supports. Each end of such sides and mid supports include hook shaped ends designated H1, H2 and H3, H4 Hooks H1 and H3 are closed about cross supports 20*b*, 20*c* of leg 15 to permit rotation thereabout in Arrow direction C, D while hooks H2, H4 are open to be removably received about cross members 21*b*, 21*c* of leg 16. This rotational movement and hooking aspect will bring the rack 10 into a substantially three dimensional rectangular configuration and provide a rigid unit with sufficient supporting strength to support articles thereon.

As illustrated, the middle and top shelf 25, 26 are each provided with a plurality of cross members 25*a*, 26*a* secured to the sides and mid supports thereof. Each of these shelves, including lower 11, middle 25 and top 26 each provide an open gridwork but it should be obvious that to make such shelves of a single sheet of material would not depart from the scope of the invention providing that the rotational connections were maintained for collapsing of the unit and the erection and locking of the unit into erected position were maintained. The open gridwork provides a support surface as would a single sheet of material.

The use of the unit should be obvious. From the collapsed or storage position, leg 15, carrying the mid 25 and top 26 shelves is completely rotated about the end 11*e* of shelf 11, leg 16 is rotated about end 11*d* of shelf 11 to substantially bring the same to a vertical position and thereafter the shelves 25, 26 are rotated about leg 15 to bring the hooks H2, H4 thereof into engagement with cross bars 21*b*, 21*c* of leg 16.

In its assembled form, the unit 10 is receivable into a stove oven and will normally rest upon and be supported by the lowest oven shelf. After baking, the entire unit is removed from the oven and may then be utilized as a cooling rack.

One of the important aspect of the invention is the fact that to collapse the unit, it is not essential that any pin, screws or other connectors or joining elements are required and all elements of the unit remain together, thus preventing loss of any necessary article.

What is claimed is:

1. A multi-layer baking and cooking rack including:

a. a plurality of planar shelves each having a forward and a rearward end;

b. a first of said shelves having leg means at its forward and rearward end, said legs being rotatably attached to said shelf;

c. at least a pair of shelves being rotatably attached at said rearward end to one of said legs and being spaced thereon;

d. each of said pair of shelves having attachment means on said forward end thereof; and, e. said attachment means being connectable to the other of said legs to provide a generally three dimensional rectangular shape to said shelves and legs when so attached.

2. The rack as set forth in claim 1 and each of said shelves and said legs being formed of joined, individual wires of predetermined lengths.

3. The rack as set forth in claim 1 and said attachment means including hooks receivable on a selected portion of said other leg.

4. The rack as set forth in claim 1 and said legs and said shelves being collapsible about said first shelf to provide a compact storage arrangement.

5. The rack as set forth in claim 1 and each of said shelves and said legs being provided of individual, longitudinally extending wires having a wire respectively connecting the ends thereof.

* * * * *